US008472831B2

(12) United States Patent
Bettiol

(10) Patent No.: US 8,472,831 B2
(45) Date of Patent: Jun. 25, 2013

(54) INTERCHANGING COLOR PRINTER AND RELATED METHOD

(75) Inventor: David E. Bettiol, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/713,202

(22) Filed: Feb. 26, 2010

(65) Prior Publication Data

US 2011/0211856 A1 Sep. 1, 2011

(51) Int. Cl.
*G03G 15/00* (2006.01)

(52) U.S. Cl.
USPC ..... 399/82; 399/12; 399/45; 399/54

(58) Field of Classification Search
USPC ..... 399/9, 16, 23, 38, 42, 45, 53, 54, 399/75–77, 81, 110–112, 223, 228, 231, 399/12, 82
See application file for complete search history.

(56) References Cited

U.S. PATENT DOCUMENTS 6,563,524 B1 * 5/2003 Regimbal et al. ..... 347/116
7,054,567 B2 * 5/2006 Furno et al. ..... 399/38
2001/0055500 A1 * 12/2001 Katakabe et al. ..... 399/111
2005/0058465 A1 * 3/2005 Toyohara ..... 399/45
2006/0133870 A1 * 6/2006 Ng et al. ..... 399/341
2007/0153311 A1 7/2007 Carling et al.
2008/0160435 A1 * 7/2008 Lim et al. ..... 430/48

FOREIGN PATENT DOCUMENTS

JP 1 078275 A 3/1989
JP 7 114241 A 5/1995
JP 10 177285 A 6/1998
WO WO 2010/077272 A2 7/2010

* cited by examiner

*Primary Examiner* — Walter L Lindsay, Jr.
*Assistant Examiner* — Benjamin Schmitt
(74) *Attorney, Agent, or Firm* — Donna P. Suchy; Roland R. Schindler

(57) ABSTRACT

A method may include the steps of providing a printing assembly that includes a plurality of printing modules that each include a specific toner color, wherein a first printing module is failing and at least one second printing module is functioning; determining a toner use demand for the plurality of printing modules; and swapping the first printing module with the at least one second printing module to facilitate reducing a downtime of the printing apparatus, wherein the first printing module has a toner use demand that is substantially greater than the toner use demand of the at least one second printing module.

8 Claims, 4 Drawing Sheets

INTERCHANGING COLOR PRINTER AND RELATED METHOD

FIELD OF THE INVENTION

This invention relates in general to electrographic printing, and more particularly to print on paper or transparency interchangeable multi-toner printing apparatus.

BACKGROUND OF THE INVENTION

One method for printing images on a receiver member is referred to as electrophotography. In one example, an electrophotographic printing device may create multi-color toner images using a plurality of color imaging printing modules coupled within the printing device. The printing modules may be arranged in tandem such that the toner images are successively electrostatically transferred to the receiver member.

Known examples of printing devices may deposit toner at specific locations on the receiver member and/or on top of other previously deposited toner using the plurality of printing modules. Once the receiver member has received the appropriate toner images the final print image may be permanently fixed to the receiver member typically using heat, and/or pressure. Multiple layers or marking materials can be overlaid on one receiver, for example, layers of different color particles can be overlaid on one receiver member to form a multi-color print image on the receiver member after fixing.

Many printing jobs such as in packaging require printing using interchangeable substrates or imaging modules. The present invention offers these options in an efficient and cost-efficient manner.

SUMMARY OF THE INVENTION

A method for increasing color interchangeability of 2 or more imaging modules, for example, the use of a white dry ink toner in either the first position of color laydown or the final position of color laydown so that similar looks can be obtained on different types of receivers, such as both transparent transparencies and opaque sheet paper. Another embodiment uses the white dry ink toner in either the first or last imaging position allows a dry ink module to be used for printing on colored substrate where the white dry ink toner is typically applied next to the paper (first), but underneath all the subsequent colors. Alternatively that same dry ink module to be used for printing on transparent substrates where the C, M, Y, K dry ink toners are typically applied next to the paper and the white is applied farthest from the clear substrate (last).

The invention, and its objects and advantages, will become more apparent in the detailed description of the exemplary embodiments described herein.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Referring now to the accompanying drawings, FIGS. 1-4 show portions of an electrographic print engine or printer apparatus suitable for printing multi-color toner images. In one embodiment, as shown in FIGS. 1*a* and 1*b*, the printing apparatus may have four single-color image printing stations or modules arranged in tandem. In another embodiment, as shown in FIGS. 2*a* and 2*b*, the printing apparatus may have five image printing modules arranged in tandem. It is understood that the actual number of printing modules can be varied depending on the printer system employed. The invention contemplates that a plurality of printing modules may be combined to deposit toner on a single receiver member to produce multi-colored images.

This invention enables the customer to perform multiple imaging applications by altering which colors are printed in which imaging position in a multicolor printing system. The invention enables color interchangeability and takes advantage of that interchangeability to allow the same hardware and control system to be able to perform two applications. This allows a 5-color or "m-color" printer to perform the printing of a m+1 printer so that what previously would have required either a 6 color capable imaging system or multiple imaging systems now can be printed by a 5 color printer system. Both the colored substrate application and the transparent substrate application can now be performed on a 5 color capable imaging system.

Figure 1A:
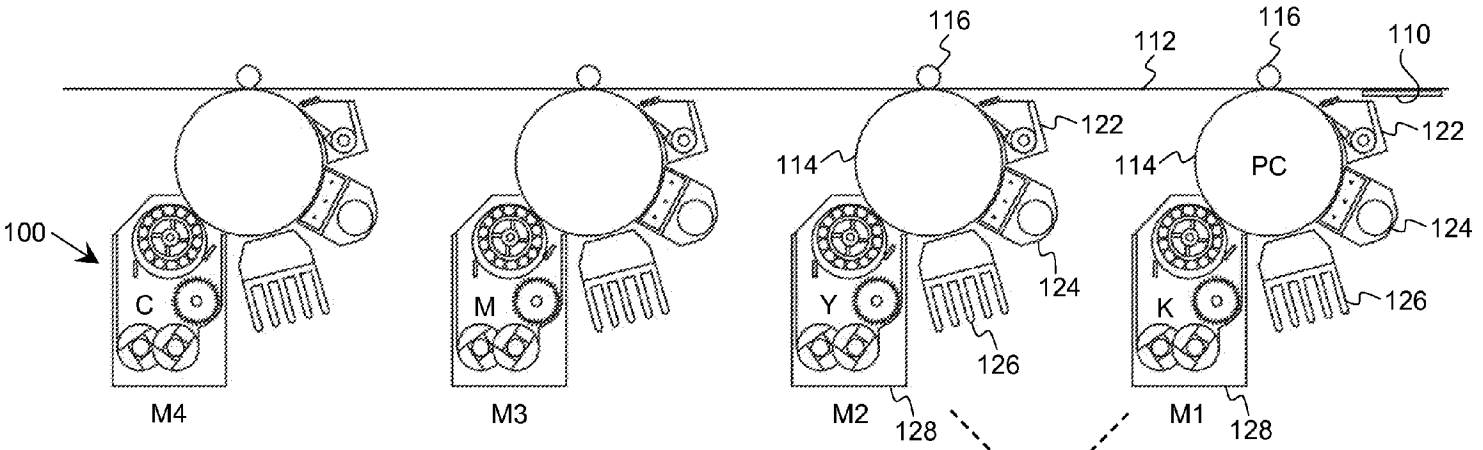
FIG. 1*a* is a schematic cross-sectional side view of an electrographic reproduction apparatus suitable for use with this invention.
Figure 1B:
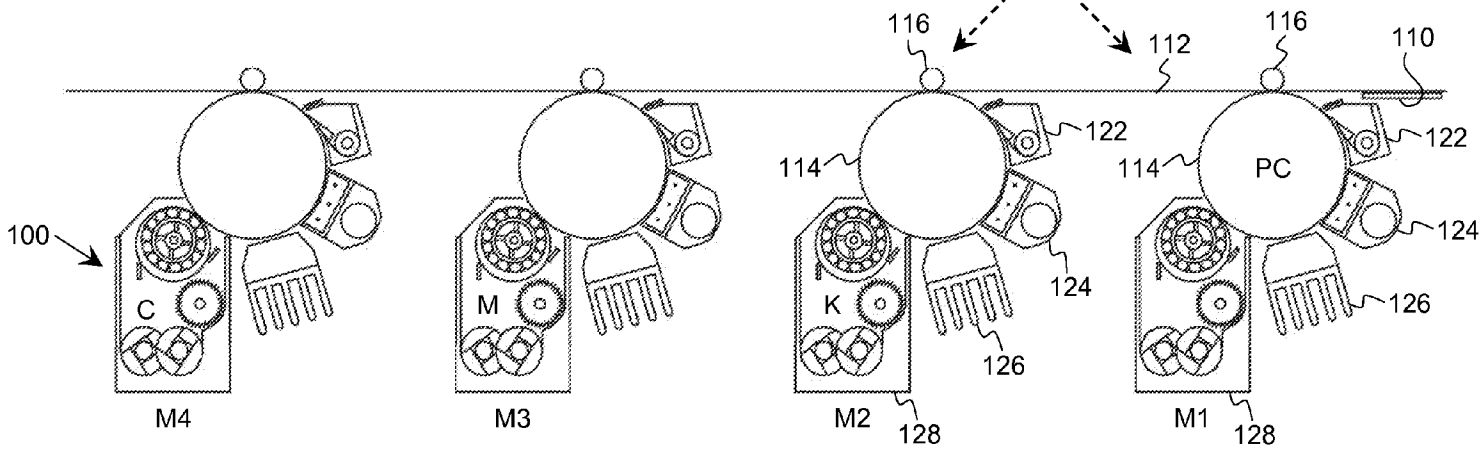
FIG. 1*b* is a schematic cross-sectional side view of the electrographic reproduction apparatus shown in FIG. 1*a;*

FIGS. 1*a* and 1*b* are side elevation views of an electrographic printing apparatus 100. In such an embodiment, printing apparatus 100 may include four printing modules, generally indicated as M1, M2, M3 and M4. Printing modules M1-M4 may be arranged in tandem and coupled within printing apparatus 100. Each of printing modules M1-M4 may generate a single-color toner image and may facilitate transferring that image to a receiver member 110 that may be successively moved through printing modules M1-M4. It should be understood that printing apparatus 100 is not limited to this tandem orientation or any other orientation. In the exemplary embodiment, printing module M1 may form black (K) toner color separation images, printing module M2 may form yellow (Y) toner color separation images, printing module M3 may form magenta (M) toner color separation images, and printing module M4 may form cyan (C) toner color separation images.

In one embodiment, printing modules M1-M4 may be rotatably coupled to a transport device, such as endless belt web 112. A plurality of receiver members 110 may be coupled to belt web 112, wherein each receiver member 110 may receive the print image. Receiver members 110 may be removably electrostatically coupled to belt web 112 via corona tack-down chargers (not shown) or by mechanical devices such as grippers (not shown).

Figure 2A:
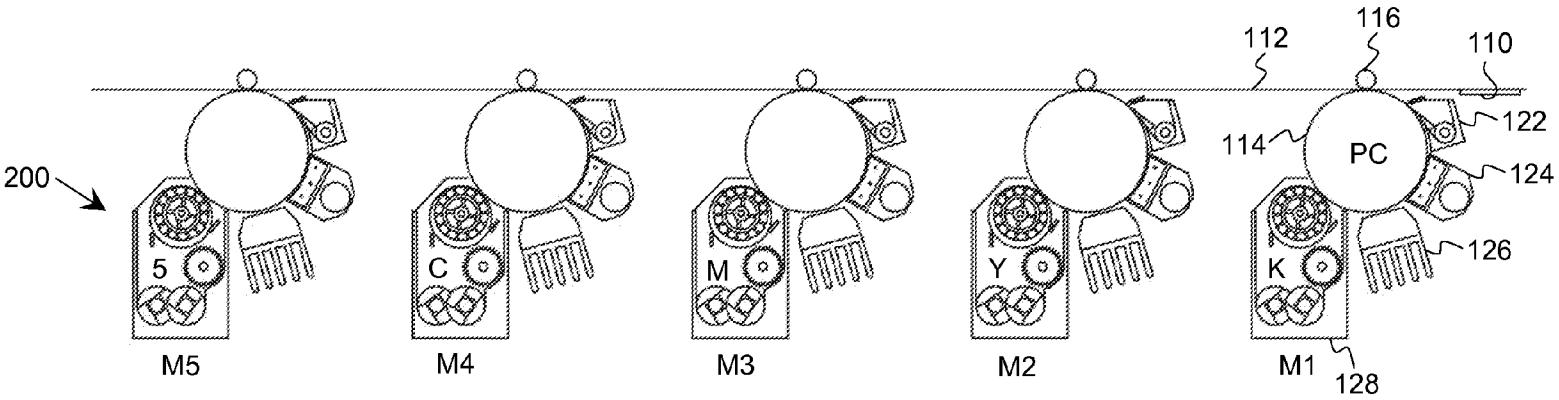
FIG. 2*a* is a schematic cross-sectional side view of another embodiment of an electrographic reproduction apparatus.
Figure 2B:
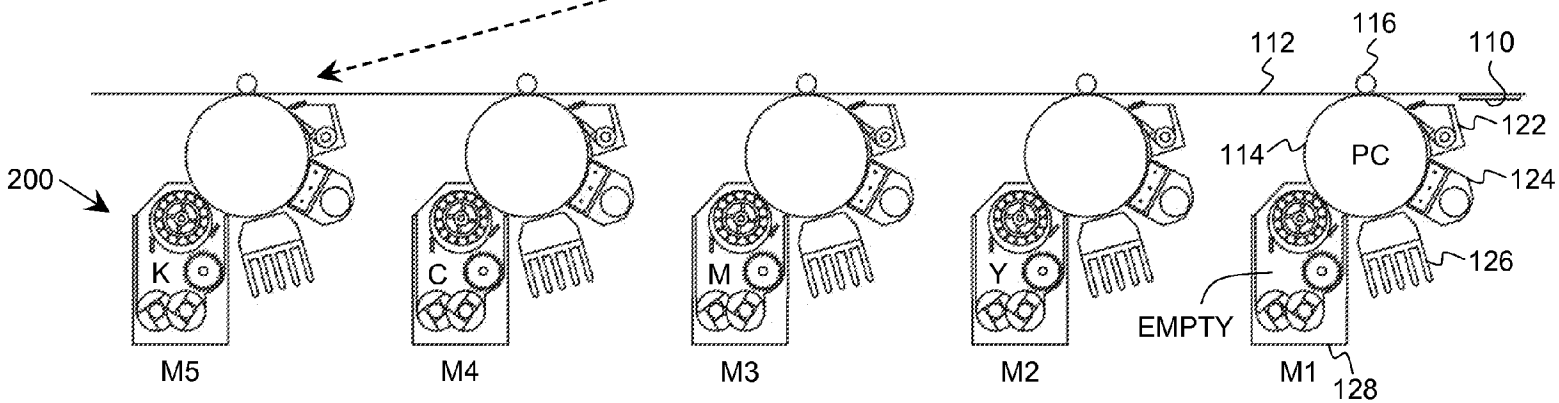
FIG. 2*b* is a schematic cross-sectional side view of the electrographic reproduction apparatus shown in FIG. 2*a;*

FIGS. 2*a* and 2*b* are side elevation views of an alternative printing apparatus 200 also referred to as a printing assembly. Components of printing apparatus 200 are substantially similar to components of printing apparatus 100 and therefore like components are identified with like reference numerals. Printing apparatus 200 may include printing modules M1, M2, M3 and M4. Moreover, printing apparatus 200 may also include a fifth printing module M5 that may include any fifth color, a clear toner or any of the four colors black (K), yellow (Y), magenta (M) or cyan (C) that may be contained within printing modules M1-M4 as described above. In one embodiment, printing modules M1-M5 may be arranged in tandem and coupled within printing apparatus 200. In another embodiment, printing modules M1-M5 may be arranged in any other orientation.

Similarly, as described above, in one embodiment, printing modules M1-M5 may be rotatably coupled to belt web 112. The plurality of receiver members 110 may be coupled to belt web 112, wherein each receiver member 110 may receive the print image. Receiver members 110 may be removably electrostatically coupled to belt web 112 via the corona tack-down chargers or the grippers.

Figure 3:
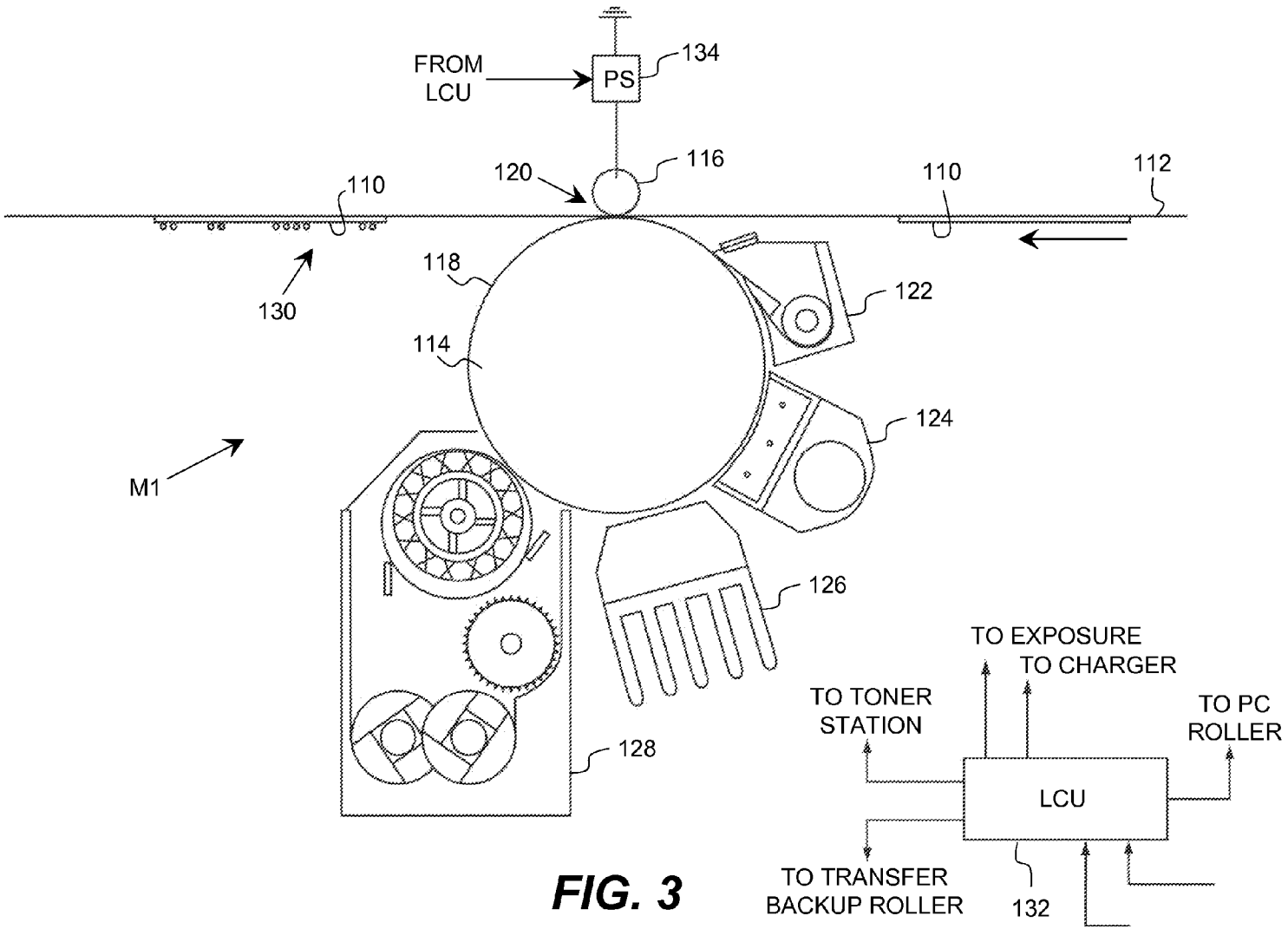
FIG. 3 is an enlarged schematic cross-sectional side view of one printing module.

FIG. 3 is an enlarged side view of printing module M1. It should be understood that each of the printing modules M1-M5 are substantially identical. As a result, the following description of printing module M1 may apply to printing modules M2-M5. In the exemplary embodiment, printing module M1 may include a photoconductive imaging roller 114 and a transfer backup roller 116. Photoconductive imaging roller 114 may have a surface 118 that may be rotatably coupled to belt web 112. Transfer backup roller 116 may also be rotatably coupled to belt web 112 such that transfer backup roller 116 may be positioned substantially adjacent to photoconductive imaging roller 114 such that a transfer nip 120 may be defined therebetween.

Printing module M1 may also include a plurality of electrographic imaging subsystems for producing one or more multilayered images or patterns. For example, in one embodiment, printing module M1 may include a cleaner system 122 that may be operatively coupled to surface 118. Printing module M1 may also include a primary charging system 124 that is operatively coupled to surface 118 of photoconductive imaging roller 114, wherein primary charging system 124 may facilitate uniformly electrostatically charging surface 118. Moreover, printing module M1 may include an exposure subsystem 126 that may be operatively coupled to surface 118, wherein exposure subsystem 126 may facilitate image-wise modulating the uniform electrostatic charge by exposing photoconductive imaging roller 114 to form a latent electrostatic multi-layer (separation) image of the respective layers. Printing module M1 may also include a dry ink, or toner station 128 that may be operatively coupled to surface 118, wherein toner station 128 may facilitate depositing a color toner image 130 on surface 118 of photoconductive imaging roller 114.

A logic control unit (LCU) 132 may be provided and may include a microprocessor incorporating suitable look-up tables and control software, which may be executable by LCU 132. The control software may be stored in a memory associated with LCU 132. The control software may include image processing algorithms that facilitate sending the correct image data, or plane, to the appropriate printing module. Moreover, each printing module M1-M5 may have unique calibrations that are color specific and/or module specific. In one embodiment, LCU 132 may facilitate reassigning the unique calibrations to another printing module, as described in more detail below. In another embodiment, LCU 132 may facilitate repeating, or copying, the unique calibrations for a specific color to a different printing module, as described in more detail below. Each toner station 128 may include a toner color identifier (not shown) that may be detected by a plurality of sensors (not shown) coupled within printing modules M1-M5. In a non-limiting example, LCU 132 may automatically reprogram printing module M1 in response to the sensors in the event toner station 128 is swapped out of one of the other printing modules M2-M5 and coupled within printing module M1. Furthermore, LCU 132 may generally nominalize and/or optimize the operating parameters and reduce errors which are attributable to the printing process.

A power supply unit 134 may provide individual transfer currents to the transfer backup rollers 116. LCU 132 may provide control of the various components and process control parameters of the apparatus in response to signals from various sensors (not shown) associated with the electrophotographic printer apparatus. LCU 132 may also provide timing and control signals to the respective components to provide control of the printing apparatus in accordance with well understood and known.

During operation, receiver members 110 may be channeled from a paper supply unit (not shown) and transported through the printing modules M1-M5 in a direction as indicated in FIG. 3. Receiver members 110 may be coupled to belt web 112 electrostatically coupled via the corona tack-down chargers. As a result, receiver member 110 may be channeled from the supply source towards transfer nip 120 of printing module M1. In the exemplary embodiment, a colored toner image may be created on surface 118 by exposure subsystem 126, charging system 124 and toner station 128. Photoconductive imaging roller 114 may transfer the respective toner layer (separation) image to receiver member 110. As a result, an unfused toner image 130 may be formed on receiver member 110 shown in FIG. 3 as exiting transfer nip 120. Receiver member 110 may then be channeled towards printing modules M2-M5 wherein receiver member 110 may receive additional toner images coupled thereon. Finally, receiver member 110 may be channeled to a finishing assembly (not shown) that facilitates fusing toner image 130 to receiver member 110.

This invention enables the customer to perform multiple imaging applications by altering which colors are printed in which imaging position in a multicolor printing system having multiple printer modes as shown in FIG. 3. The invention enables color interchangeability and takes advantage of the interchangeability to allow the same hardware and control system to be able to perform two or more applications. This allows a 5 color or m color printer, as shown in FIG. 3, to perform the printing of a m+1 printer so that what previously would have required either a 6 color capable imaging system or more now can be printed by a 5 color (m) printer system. In the exemplary embodiment, printing module M1 may deposit black (K) toner color separation images; printing module M2 may deposit yellow (Y) toner color separation images; printing module M3 may deposit magenta (M) toner color separation images; and printing module M4 may deposit cyan (C) toner color separation images. An optional printing module M5, as shown in printing assembly 200 in FIGS. 2*a* and 2*b*, may form colors such as red, blue, green or any other color separation image, a clear toner, a gloss finish or type of film.

Figure 4:
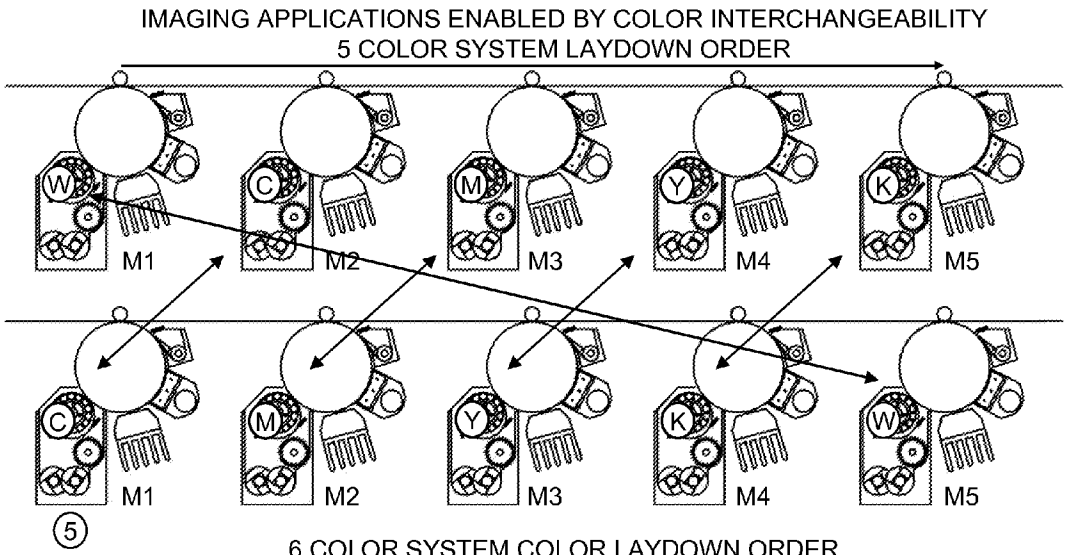
FIG. 4 is a schematic cross-sectional side view of another embodiment of an electrographic reproduction apparatus.

One embodiment of the printing apparatus also referred to as an interchangeable printer 300 is shown in FIG. 4, having a fifth printing module M5. The printer is capable of printing using one or more colors such as Black (K) of the colors, Yellow (Y), Magenta (M) and Cyan (C) using printing modules M1-M4, respectively. The printing apparatus 300 has components like those described above for the printer or printing apparatus 200. In one embodiment where white is needed the printing module M5 also can print a black K-colored toner, or any color that has a high demand and a known substrate type to be printed on. The substrate type then determines which of the color modules will print and in what order. This embodiment does not need the printer to automatically adjust the placement of the modules since the operator does this manually prior to printing as shown in FIG. 4. In this example the white toner module is first to print for a colored substrate and is changed to the last to print with a transparent substrate resulting in the same look as on the other paper.

Figure 5:
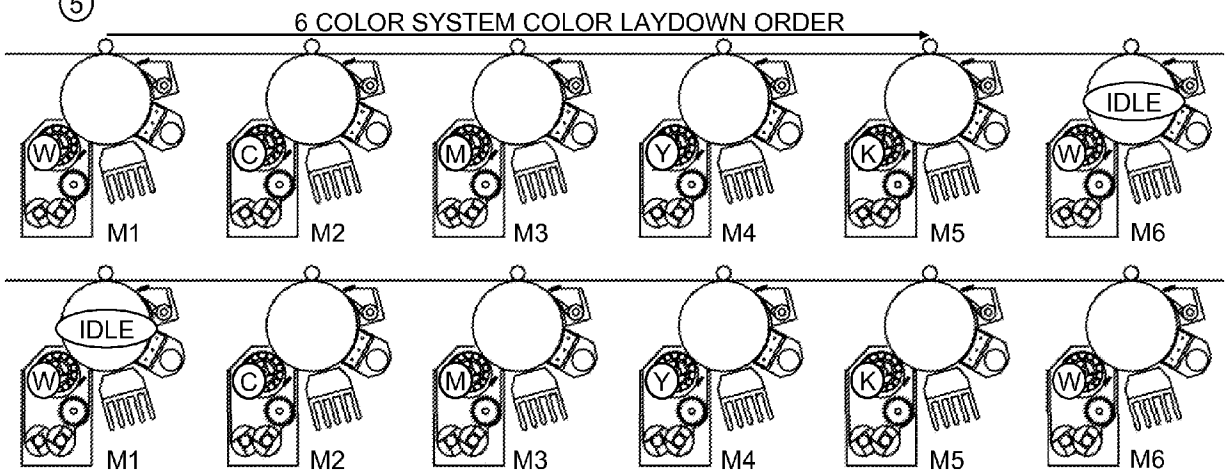
FIG. 5 is a schematic cross section of another embodiment.

Another embodiment is shown in FIG. 5 is an automatic embodiment where a 6 color capable printing system has white in, both the first and last (sixth) imaging module locations, thereby eliminating any need to manually interchange modules, and still accomplish the required laydown order on various substrate types such as the colored substrate and the transparent substrate used the same imaging system without operator intervention.

In the embodiment shown in FIG. 5 the printer automatically determines a substrate type by various methods of detection such as a densitometer, or any optical sensors that detects light transmittability and/or reflectivity. Substrate types can be classified by various measurements such as surface charactures, color hue of substrate in relation to the surface, printed indicia and other relevant substrate characters.

This embodiment is an exemplary non-limiting example of color interchangeability of the imaging modules enables the use of a white dry ink toner in either the first position of color laydown or the final position of color laydown. This means of increasing color interchangeability of imaging modules could actually apply to any color or set of colors but the example of white shows how effective this can be in different circumstances. For example the ability to have white dry ink toner in either the first or last imaging position allows a dry ink module to be used for printing on colored substrate where the white dry ink toner is typically applied next to the paper (first), but underneath all the subsequent colors. Alternatively that same dry ink module to be used for printing on transparent substrates where the C, M, Y, K dry ink toners are typically applied next to the paper and the white is applied farthest from the clear substrate (last). When the white is printed as the first layer of toner on the paper substrate it can be used for printing on colored substrates and preserves the color integrity of the other colors placed on top of it. This means it acts like a white paper backing on the colored papers. When the white is printed as the last layer of toner ink on clear substrate, appears as white wherever white is needed as a reverse image as for a backlit display or a packaging label.

This method for functionally interchanging printing modules during printing for this invention uses the steps of providing a printing assembly (400) that includes a plurality of printing modules (M1-M4) that each include a specific toner color, wherein a first printing module (M1) assigned a toner, such as a white toner, prints the first color (white) toner. The second printing module (M2) prints a second color toner and a controller controls the first printing module (M1) in relation to the at least one second printing module (M2) to facilitate an adjustment of the printing apparatus (100), wherein the first printing module (M1) has a white toner use demand or it is predetermined that the white toner is a substantially better fit to the receiver and image.

This invention can be used in conjunction with U.S. Ser. No. 12/330,772, filed Dec. 9, 2008 to detect and correct for module which is hereby incorporated by reference.

The invention has been described in detail with particular reference to certain preferred embodiments thereof, but it will be understood that variations and modifications can be effected within the spirit and scope of the invention.

| PARTS LIST | |
|---|---|
| Printing apparatus | 100 |
| Receiver member | 110 |
| Belt web | 112 |
| Photoconductive imaging roller | 114 |
| Transfer backup roller | 116 |
| Surface | 118 |
| Cleaner system | 122 |
| Charging system | 124 |
| Exposure subsystem | 126 |
| Toner station | 128 |
| Color toner image | 130 |
| Logic control unit | 132 |
| Power supply unit | 134 |
| Printing assembly | 200 |
| Interchangeable printer or printing apparatus | 300 |

What is claimed is:

1. An apparatus for producing a digitally patterned image upon a receiver transported on a support to a fusing station, the apparatus comprising:

a. a printing assembly including a plurality of printing modules each having a specific toner color, wherein a first printing module is arranged to print a first toner of a first color, and a second printing module is positioned after the first printing module to print a second toner of a second color and a third printing module, positioned after the second printing module, is arranged to print the first color;

b. a controller for controlling the plurality of printing modules to form the image by applying a plurality of colors on the receiver upstream of the fusing station using the plurality of printing modules to print images having either the first toner printed before the second toner, or the second toner printed before the first toner, based on the receiver;

c. a memory with one or more printing module determined positions relative to a first and a second receiver type where a first and a second receiver are to look similar; and d. the fusing station treats the receiver to fuse the image.

2. The apparatus of claim 1, further comprising at least one control sensor for detecting the receiver type.

3. The apparatus of claim 1, further comprising a color toner sensor to detect a color toner in one or more printing modules.

4. The apparatus of claim 1, further comprising a final detector to capture a final first print for use in a second print on the second receiver that is to look identical to the first receiver.

5. The apparatus of claim 1 further using memory to store a print module sequence for the first and the second receiver type.

6. The apparatus of claim 5 wherein a first sensor is used to capture a print module sequence information.

7. The apparatus of claim 6 wherein a second sensor is used to capture the print module sequence information.

8. The apparatus of claim 5 wherein user input is used to capture a print module sequence information.

* * * * *